US007448657B2

(12) United States Patent
Blair

(10) Patent No.: US 7,448,657 B2
(45) Date of Patent: Nov. 11, 2008

(54) DOOR STOP

(76) Inventor: James J. Blair, 1715 Clements Dr., Apt. 9G, Ashland, KY (US) 41101

( * ) Notice: Subject to any disclaimer, the term of this patent is extended or adjusted under 35 U.S.C. 154(b) by 0 days.

(21) Appl. No.: 11/256,309

(22) Filed: Oct. 21, 2005

(65) Prior Publication Data

US 2007/0090656 A1 Apr. 26, 2007

(51) Int. Cl.
*E05C 17/54* (2006.01)

(52) U.S. Cl. ..... 292/338; 292/339; 292/342; 292/343; 292/DIG. 15

(58) Field of Classification Search ..... 292/338, 292/DIG. 15 X, 339, 66, 342, 343, 288; 16/DIG. 17, 16/DIG. 10, 85, 82, 86 C
See application file for complete search history.

(56) References Cited

U.S. PATENT DOCUMENTS

| | | | | | |
|---|---|---|---|---|---|
| 709,057 | A | * | 9/1902 | Smith | 292/339 |
| 778,823 | A | * | 12/1904 | Fay | 292/339 |
| 1,110,628 | A | * | 9/1914 | Hendrix | 292/338 |
| 1,185,547 | A | | 5/1916 | Rugar | |
| 1,246,160 | A | | 11/1917 | Roberts | |
| 1,656,394 | A | * | 1/1928 | Sasgen | 292/338 |
| 1,879,119 | A | * | 9/1932 | Dauble | 292/338 |
| 3,006,676 | A | | 10/1961 | Germock, Jr. | |
| 4,076,293 | A | | 2/1978 | Valles | |
| 4,079,972 | A | | 3/1978 | Hagopian | |
| 4,139,227 | A | | 2/1979 | Spurr | |
| 4,231,599 | A | | 11/1980 | Gayman | |
| 4,290,636 | A | | 9/1981 | Steele | |
| 4,438,640 | A | | 3/1984 | Willis | |
| 4,563,027 | A | | 1/1986 | Chechovsky et al. | |
| 4,666,195 | A | | 5/1987 | Thomas, III | |
| 4,676,536 | A | | 6/1987 | Arbic et al. | |
| 4,805,948 | A | | 2/1989 | Renzi | |
| 4,822,086 | A | | 4/1989 | Brown | |
| 4,883,297 | A | | 11/1989 | Smith | |
| 4,971,374 | A | | 11/1990 | Lovell et al. | |
| 5,064,232 | A | | 11/1991 | Quarberg | |
| 5,098,138 | A | * | 3/1992 | Vandewege | 292/66 |
| 5,250,927 | A | | 10/1993 | Nevels | |
| 5,544,386 | A | | 8/1996 | Cobb | |

(Continued)

*Primary Examiner*—Patricia Engle
*Assistant Examiner*—Mark Williams
(74) *Attorney, Agent, or Firm*—Carrithers Law Office PLLC; David W. Carrithers

(57) ABSTRACT

A door stop which includes a bracket that is mountable on a face of a door and has an elongate leg pivotally connected adjacent one end thereof to the bracket. The leg has a laterally extending floor engagable foot on the other end thereof that slopes downwardly in a direction toward the floor and terminates in an edge that digs into the floor as the door is being force open. The leg is squeezingly engaged between a pair of grommets on the bracket which holds the leg is a raised position. A tension spring biases the foot from its raised position in a direction toward the floor. An actuator is mounted on the door and has a hand engagable portion disposed adjacent the door knob. The actuator is a rod that is reciprocally mounted on the door and spring biased to a neutral position. The rod upon being pushed downwardly engages and released the leg so that it is free to snap downwardly into its floor engaging door blocking position. Optionally there is tie strap that extends downwardly from the bracket and terminates in a portion that projects under a lower edge of the door.

7 Claims, 2 Drawing Sheets

U.S. PATENT DOCUMENTS 5,725,263 A 3/1998 Rodriguez
5,951,072 A 9/1999 McElary
6,120,072 A * 9/2000 Benedict ..... 292/338
6,454,323 B1 9/2002 Mills
6,513,778 B2 2/2003 Hefley et al.
2002/0093209 A1 7/2002 Gerchow et al.

* cited by examiner

DOOR STOP

TECHNICAL FIELD

The present invention relates generally to a self adjusting pivoting door stop which includes a quick release mechanism.

BACKGROUND OF THE INVENTION

With home invasions occurring there is need for means that will respond rapidly to block a door. This is particularly so for seniors most of whom trustingly open an entry door upon hearing a knock.

There is also comfort in knowing before going to bed that a door is blocked in such a manner as to make it difficult if not next to impossible for a burglar or other unwanted intruder to enter while one is sleeping.

Door stops are known and by way of example attention is directed to the following United States Patents: U.S. Pat. No. 1,185,547 granted May 30, 1916 to F. D. Rugar, U.S. Pat. No. 1,246,160 granted Nov. 13, 1917 to H. B. Roberts, and U.S. Pat. No. 3,006,676 granted Oct. 31, 1961 to J. Germock Jr. None of the foregoing provide a quick response and secure door block as claimed in the instant invention disclosed herein.

SUMMARY OF THE INVENTION

A principal object of the present invention is to provide a door stop that is effective in blocking a door and one which can be quickly released and also respond quickly in the event of an attempted forced entry.

One preferred embodiment defines a door stop which includes a bracket that is mountable on a face of a door and has an elongate leg pivotally connected adjacent one end thereof to the bracket. The leg has a laterally extending floor engagable biting foot on the other end thereof that slopes downwardly in a direction toward the floor, terminates in an edge that digs into the floor as the door is being forced open and bites further into the floor as more opening force is applied to the door. The leg is squeezingly engaged between a pair of grommets on the bracket which holds the leg in a raised position. A tension spring biases the foot from its raised position in a direction toward the floor. An actuator is mounted on the door and has a hand engagable portion disposed adjacent the door knob. The actuator is a rod that is reciprocally mounted on the door and spring biased to a neutral position. The rod upon being pushed downwardly engages and releases the leg so that it is free to snap downwardly into its floor engaging door blocking position. Optionally there is a tie strap that extends downwardly from the bracket and terminates in a portion that projects under a lower edge of the door.

In keeping with the foregoing there is provided a door stop comprising a bracket mountable on a face of a door; an elongate leg pivotally connected adjacent one end thereof to the bracket and having an enlargement on the other end thereof providing a floor engaging head portion; means on the bracket engaging the leg when the enlargement is in a raised position to thereby retain the head portion in the raised position; and spring means biasing the head portion from the raised position to a floor engaging lower position. Optionally the mounting bracket can include a tie strap that extends downwardly therefrom and terminates in a portion that projects under a lower edge of the door. An actuator can also be mounted on the door to facilitate releasing the floor engaging head portion permitting it to snap by virtue of the spring bias to its lower floor engaging position.

BRIEF DESCRIPTION OF THE DRAWINGS

A better understanding of the present invention will be had upon reference to the following description in conjunction with the accompanying drawings in which like numerals refer to like parts throughout the several views and wherein.

DESCRIPTION OF THE PREFERRED EMBODIMENTS

Figure 1:
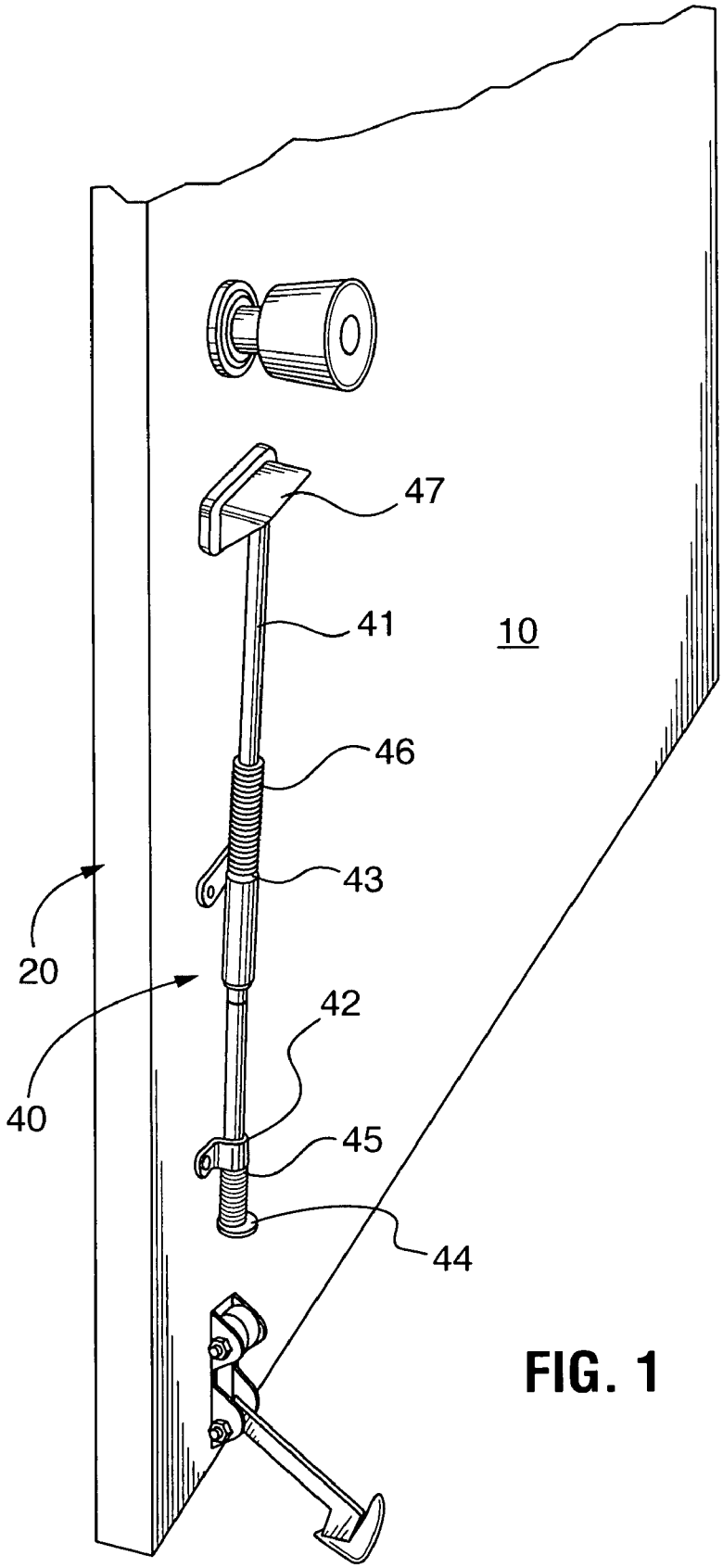
FIG. 1 is an oblique view of a portion of a door with applicants door stop and actuating mechanism mounted thereon.
Figure 2:
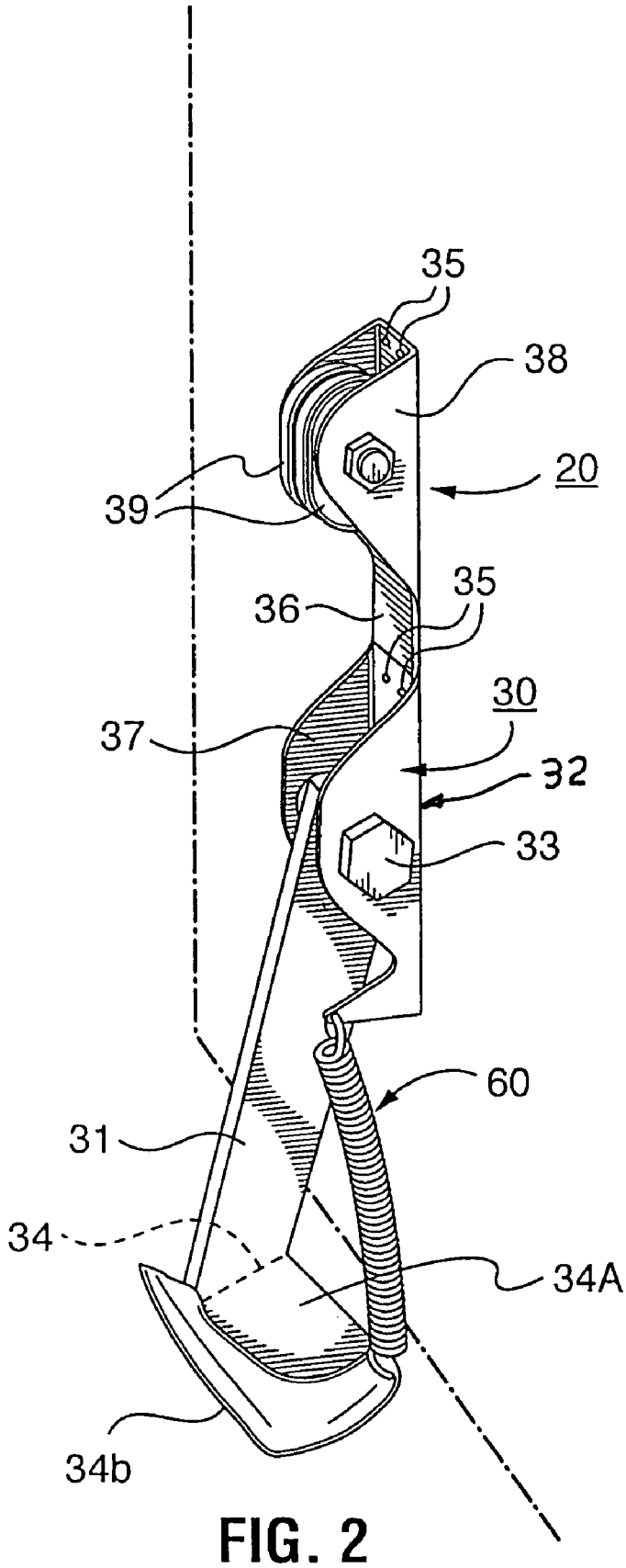
FIG. 2 is an oblique view, from another position, of the door stop portion only including an optional tension spring.

Illustrated in the drawings is a door stop system 10 mounted on a face of a door 20. The system 10 comprises a door stop portion 30 and a door stop actuating mechanism 40.

The door stop 30 comprises an elongate leg 31 pivotally attached adjacent one end thereof to a bracket 32 via a pin 33, or other suitable mechanism, which in turn is secured to the door by for example a plurality of screws 35. The leg 31 has a foot 34 extending laterally therefrom generally in a direction parallel to the face of the door and pivot axis of the pin 33. The foot 34 is a generally flat blade that is sloped relative to the length of the leg as represented by the line 34A which is the juncture of the blade with the leg. The slope provides a leading edge 34B, remote from the door face when the leg is pivoted down to its lower position, that engages the floor in a digging in like door blocking position. In this position the elongate leg 31 is disposed at a small angle (acute angle less than 90 degrees) relative to the face of the floor.

Figure 3:
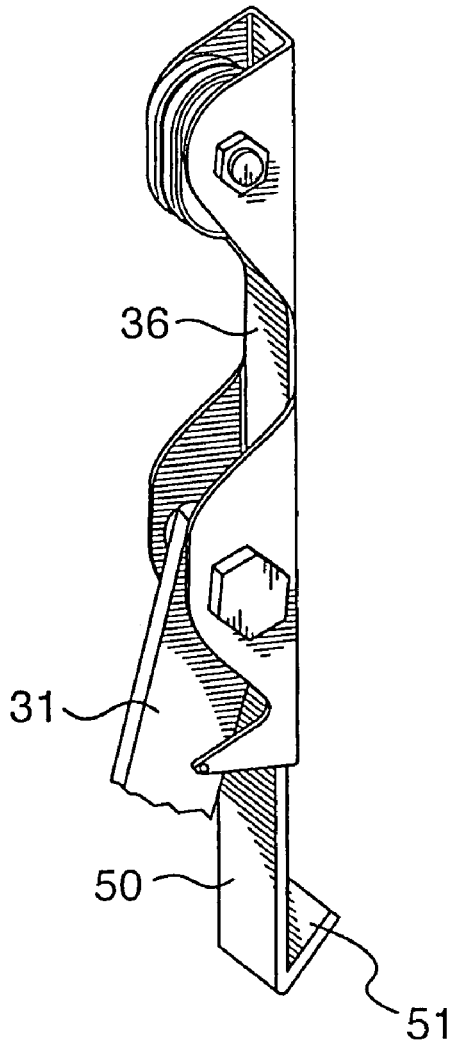
FIG. 3 is an oblique view, on a smaller scale, illustrating an optional mounting bracket with a tie strap for further securely fastening the door stop to the door.

The bracket 32 has a base 36 with suitably positioned apertures therethrough for the fastening screws and first and second spaced apart respective pairs of lugs 37, 38 projecting from the base. The screw fastening means may not in all instances be sufficient, particularly on hollow core doors, in which case there is provided an optional bracket tie strap 50 (see FIG. 3) that extends downwardly from the bracket 32 and terminates in a portion 51 that projects under the lower edge of the door. If desired the portion 51 can have a screw or nail driven therethrough into the lower edge of the door.

The tie strap 50 maybe a continuation of the bracket base 36 or alternatively a separate strap that partially overlies(or underlies) the bracket base 36 and anchored by having one or more of the bracket fastening screws 35 passing therethrough. Should the tie strap be a continuation of the bracket base 36 (which is the case illustrated in FIG. 3) one could use double faced tape to fasten the bracket to the door and rely on the strap portion 51 under the edge of the door and fastening screw(s) therethrough to counter act reactionary forces of the leg 31 when blocking opening of the door on which the device is mounted.

The leg 31 pivot mounting pin 33 passes through the pair of lugs 37 and disposed between and secured to the other pair of lugs 38 is a pair of rubber ( or other resilient) grommets 39. The leg 31 is retained in a raised position by being forceably squeezed between the pair of rubber grommets 39. In the raised position the stop is cocked in readiness for the floor engaging head 34 to drop into a door blocking floor engaging position. A quick action is provided by a tension spring 60 that is anchored respectively at opposite ends thereof to the bracket 32 and the free outer end of the leg head 34, and resiliently biases the arm head into a floor engaging position.

For convenience in releasing the door stop from its cocked position there is provided a suitably located actuator comprising a rod 41 that is reciprocally mounted on the door by respective vertically spaced apart brackets 42, 43. The rod 41 terminates at (or adjacent) the lower end thereof in a wedge shaped head 44 so located as to strike the leg 31, (when the leg is in its raised position) on an edge thereof disposed in face-to-face relation with the door face on which it is mounted. Compression springs 45, 46 on the rod 41 and abutting respective brackets 43, 43 keep the rod in a neutral position. The upper end of the rod terminates in a finger (or hand) engagable enlargement 47 disposed preferably in close proximity to the door knob of the door latching mechanism.

The foregoing detailed description is given primarily for clearness of understanding and no unnecessary limitations are to be understood therefrom, for modifications will become obvious to those skilled in the art based upon more recent disclosures and may be made without departing from the spirit of the invention and scope of the appended claims.

I claim:

1. A door stop assembly comprising:

a bracket mountable on a face of a door said bracket comprising a base including a first set of spaced apart lugs including a pivot pin extending therethrough for pivotally connecting an elongate leg to said bracket and a second set of spaced apart lugs projecting therefrom including resilient grommets, and means for attaching said base to a surface of said door;

an elongate leg pivotally connecting an adjacent end of said bracket, said elongate leg having an enlargement on the other end thereof defining a foot comprising a generally flat blade sloping relative to said elongate leg defining a leading edge providing a floor engaging and biting foot portion;

said grommet means on said bracket engaging said leg when said enlargement is in a raised position to thereby retain said head portion in said raised position;

tension spring means extending from said foot to said bracket anchoring on said bracket in close proximity to said pivot pin biasing said head portion from said raised position to a floor engaging position, said and biting lower position in such a manner that said head will cut into said floor, locking itself deeper into the floor material making entry almost impossible;

an actuator comprising a rod reciprocally mounting on said door by mounting means, at least one compression spring cooperatively mounting on said rod, said rod including a handle on its upper distal end and said rod terminating at a lower end thereof in a head spring biased in a neutral position for releasing said leg and said foot from a disengaged resting or raised position upon a user pushing downwardly on said handle striking said foot of said bracket with said head of said actuator pivoting said leg and said foot into a floor engaging door blocking position.

2. The door stop assembly as defined in claim 1 including a tie strap that extends from said bracket and terminates in an angularly disposed end portion adapted to project under a lower edge of the door.

3. The door stop assembly as defined in claim 2 wherein said bracket has a base portion and wherein said tie strap comprises a continuation of said base portion.

4. The door stop assembly as defined in claim 3 including a first and second pair of lugs projecting outwardly from said base, wherein said leg is pivotally connected to said first pair of lugs and wherein said means retaining said leg with the enlargement thereon in its raised position comprises a pair of resilient members on and disposed between the lugs of said second pair of lugs.

5. The door stop assembly as defined in claim 1 wherein said leg and head comprises a strap of metal bent at right angles with a first portion providing said leg and a second portion providing said floor engaging head and wherein said second portion is sloped at an acute angle relative to the length of the leg and thereby providing a sharp leading edge that engages and bites into the floor.

6. The door stop assembly as defined in claim 1 wherein said actuator mounted on said door face for releasing the leg from its raised position and having a hand engagable member disposed adjacent a door latch knob on the floor.

7. The door stop assembly as defined in claim 6 wherein said actuator comprises a rod reciprocally mounted on the door, said rod having the hand engagable member on the upper end thereof and a leg engaging portion on the lower end thereof.

* * * * *